US009352378B1

(12) United States Patent
Flickinger

(10) Patent No.: US 9,352,378 B1
(45) Date of Patent: May 31, 2016

(54) MOVEABLE NECKING DIE CARRIER

(75) Inventor: Brian Flickinger, Fredonia, PA (US)

(73) Assignee: Exal Corporation, Youngstown, OH (US)

( * ) Notice: Subject to any disclaimer, the term of this patent is extended or adjusted under 35 U.S.C. 154(b) by 429 days.

(21) Appl. No.: 13/554,965

(22) Filed: Jul. 20, 2012

Related U.S. Application Data

(60) Provisional application No. 61/509,696, filed on Jul. 20, 2011.

(51) Int. Cl.
*B21D 51/26* (2006.01)
*B21D 22/20* (2006.01)

(52) U.S. Cl.
CPC ..... *B21D 51/2638* (2013.01); *B21D 22/20* (2013.01)

(58) Field of Classification Search
CPC ..... B21D 51/2615; B21D 51/2638; B21D 51/26; B21D 51/263; B21D 19/068; B21D 41/04
USPC ..... 72/94, 379.4, 715; 413/22, 76; 74/56, 74/57, 567–569
See application file for complete search history.

(56) References Cited

U.S. PATENT DOCUMENTS

| | | | | |
|---|---|---|---|---|
| 3,581,542 | A * | 6/1971 | Wahler et al. | 72/94 |
| 3,983,729 | A * | 10/1976 | Traczyk et al. | 72/43 |
| 4,519,232 | A * | 5/1985 | Traczyk et al. | 72/133 |
| 5,018,379 | A * | 5/1991 | Shirai et al. | 72/354.6 |
| 5,355,710 | A * | 10/1994 | Diekhoff | 72/379.4 |
| 7,392,775 | B2 * | 7/2008 | Krozek | 123/90.21 |
| 7,523,634 | B2 * | 4/2009 | Krozek | 72/313 |
| 7,757,533 | B2 * | 7/2010 | Krozek | 72/313 |
| 2006/0042348 | A1 * | 3/2006 | Krozek | 72/452.9 |
| 2008/0078344 | A1 * | 4/2008 | Krozek | 123/90.17 |
| 2008/0148801 | A1 * | 6/2008 | Olson et al. | 72/372 |
| 2009/0205391 | A1 * | 8/2009 | Krozek | 72/313 |

* cited by examiner

*Primary Examiner* — Shelley Self
*Assistant Examiner* — Peter Iannuzzi
(74) *Attorney, Agent, or Firm* — Paul D. Bangor, Jr.; Clark Hill, PLC

(57) ABSTRACT

A die necking apparatus comprising a co-axial helical cam set having a lower cam and an upper cam, the lower cam and upper cam sharing at least one mating surface, the lower cam attached to a co-axial cam center shaft, the upper cam attached to a co-axial forming die, and wherein axial rotation of the upper cam is adjustable relative to the lower cam.

4 Claims, 9 Drawing Sheets

Section A-A

Section A-A

Section A-A

MOVEABLE NECKING DIE CARRIER

CROSS-REFERENCE TO RELATED APPLICATIONS

This application claims the benefit of provisional patent application U.S. Ser. No. 61/509,696 filed Jul. 20, 2011 by the present inventor and is incorporated by reference herein for all purposes.

BACKGROUND OF THE INVENTION

The present disclosure is directed generally to necking die carriers for manufacture of metal containers, such as aluminum cans and bottles, and methods of manufacture thereof. Metal containers are typically made by either an impact-extrusion process or by a cupper/bodymaker process. In the impact-extrusion process, a metal slug placed in a die is impacted by a high-speed cylindrical punch causing the metal to flow backwards along the punch creating the extruded cylindrical container. The cylinder is placed over an ironing punch and the walls are narrowed while lengthening occurs. In the cupper/bodymaker process, a blank made from sheet metal is pressed into a die to form a cup-shaped cylindrical container that is wider and shorter than the finished can. The container is then transferred to a bodymaker which performs a sequential series of wall-ironing operations to narrow the cup while lengthening and thinning the walls of the cylinder.

The diameter of the cylinder opening is often reduced to provide structural integrity, to form a neck, or to provide an attachment surface for a lid or cap. The diameter of the open cylinder is reduced in a process termed "die necking" in which the diameter at the open end is gradually decreased by pushing the cylinder longitudinally into successively narrower dies. A cylindrical necking die is reciprocated axially engaging the exterior of the container while a coaxial die pilot simultaneously is moved axially in a mating manner on the interior of open end of the container. In a similar process, dies of fixed diameter, but increasing distant tapering are used to place the neck further down the length of the container, in a process termed "deep necking".

Because the necked diameter or distance of the taper of an aluminum cylinder can only be reduced in small increments due to wrinkling and tearing, the industry relies on large, high throughput machines to perform the die-necking process. Each container necking operation is performed in a necking module consisting of a rotatable turret with a plurality of identical exposed necking substations on the periphery thereof with each necking substation having a stationary necking die. For example, a conventional soda can has a diameter of $2\frac{11}{16}$ inches (a 211 container), while the neck has a diameter of $2\frac{6}{16}$ inches (a 216 neck) requiring the necking process be repeated numerous times with sequentially narrower dies. Different can fillers use cans of various sizes and lengths requiring the manufacturer to quickly adapt its necking machines and operations from one neck size to another. Any change in specification to the cylinder neck requires individually removing and replacing the dies. Thus, it would be desirable to have a necking device that is rapidly reconfigurable and more compact.

BRIEF SUMMARY OF THE INVENTION

The present disclosure is directed generally to an extending necking die carrier for the manufacture of metal containers. The necking die carrier or assembly is extendable without changing of the necking die.

In a preferred embodiment, the die necking apparatus comprises a co-axial helical cam set having a lower cam and an upper cam, the lower cam and upper cam sharing at least one mating surface, the lower cam attached to a co-axial cam center shaft, the upper cam attached to a co-axial forming die, and wherein axial rotation of the upper cam is adjustable relative to the lower cam. Axial rotation of the upper cam relative to the lower cam changes the distance of the forming die from the lower cam.

In another preferred embodiment, the die necking apparatus further comprises a hollow main body wherein the upper cam has a peripheral surface and the upper cam is slidable along its axis within the main body. In another preferred embodiment, at least one stop dog is affixed to the periphery of the upper cam, and the main body has at least one slot to slidably receive the stop dog wherein the at least one slot is aligned with the axis of the helical cam set.

In another preferred embodiment, the die necking apparatus comprises a coaxial helical cam set having a circular periphery, the helical cam set having a lower cam and an upper cam, the lower cam having a lower cam mating surface shared with an upper cam mating surface of the upper cam, the lower cam having a rear surface opposite the lower cam mating surface, the upper cam having a front surface opposite the upper cam mating surface; a cam center shaft comprising an axle and a coaxially attached disk-shaped cam plate element, wherein the cam plate element is coaxially attached to the lower cam rear surface; a forming die having a shaped inner forming surface, the forming die coaxially attached to the upper cam front surface; and a main body having a cylindrical hollow within which the cam set periphery is coaxially slidably attached, wherein axial rotation of the lower cam relative to the main body is adjustable, while axial rotation of the upper cam relative to the main body is limited by at least one stop dog.

Some preferred embodiments have at least one mating surface of the helical cam set with a shallow helical angle. Other preferred embodiments have at least one mating surface of the helical cam set with a steep helical angle. Preferred embodiments of the invention may have a plurality of land mating surfaces, bottom lands, optional intermediate lands, and top lands, and at least one mating surface having a helical angle. Other preferred embodiments have a plurality of land mating surfaces and two mating surfaces with a helical angle. Still other preferred embodiments have a plurality of land mating surfaces and three mating surfaces with a helical angle. The lands may be flat and perpendicular to the axis of the cam center shaft, or the lands may be curved.

A preferred method for die necking comprises the steps of a first rotating a helical cam set upper cam having an attached necking die with a shaped inner forming surface relative to a helical cam set lower cam, restraining the relative rotation of the helical cam set, inserting a metal container body into the necking die, and conforming the metal container body to the shape of the inner forming surface.

Preferred embodiments include using neck metal container bodies made of aluminum, aluminum alloys, copper, and other similar malleable metals and alloys. Preferred embodiments further include those where the metal container is a tube or where the metal container is a can.

Another preferred method further comprises withdrawing the metal container body from the necking die, unrestraining the relative rotation of the helical cam set, rotating the helical cam set upper cam relative to the lower cam so the necking die moves further from the lower cam, restraining the relative rotation of the helical cam set, inserting the metal container body into the necking die, and conforming the metal container body to the shape of the inner forming surface thus allowing for one necking die to perform one, two or more necking operations.

In the various preferred embodiments, the disclosed configurable necking device is particularly useful for performing "deep necking" of an aluminum cylinder intended for use as a container such as a can or bottle. The advantage of having a die carrier capable of being elongated eliminates the need to use multiple dies having various lengths that would otherwise be required for the necking process. Additionally, it is preferably possible to change the length of the die carrier between operations allowing the user to configure multiple different necking parameters for each container entering the die. In an additional preferred embodiment, the same container can be necked multiple times with the same die but at different lengths by readjusting the cam after each necking operation and reinserting the container.

BRIEF DESCRIPTION OF THE SEVERAL VIEWS OF THE DRAWING

For the present disclosure to be easily understood and readily practiced, preferred embodiments of the invention will now be described, for purposes of illustration and not limitation, in conjunction with the following figures, wherein.

DETAILED DESCRIPTION OF THE INVENTION

In the following detailed description, reference is made to the accompanying examples and figures that form a part hereof, and in which is shown, by way of illustration, specific preferred embodiments in which the inventive subject matter may be practiced. These preferred embodiments are described in sufficient detail to enable those skilled in the art to practice them, and it is to be understood that other preferred embodiments may be utilized and that structural or logical changes may be made without departing from the scope of the inventive subject matter. Such preferred embodiments of the inventive subject matter may be referred to, individually and/or collectively, herein by the term "invention" merely for convenience and without intending to voluntarily limit the scope of this application to any single invention or inventive concept if more than one is in fact disclosed. The following description is, therefore, not to be taken in a limiting sense, and the scope of the inventive subject matter is defined by the appended claims and their equivalents.

Figure 1:
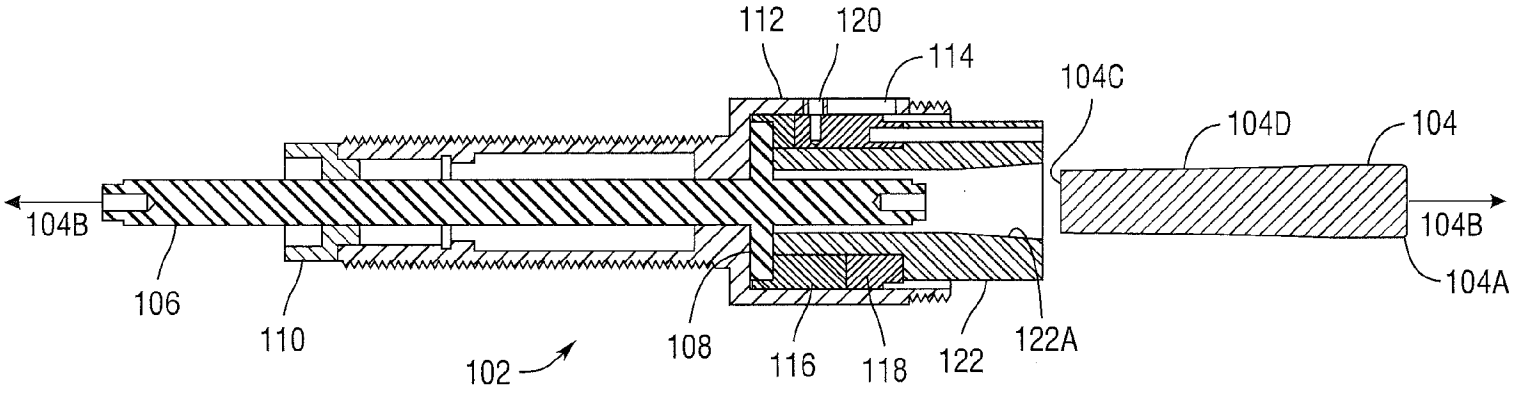
FIG. 1 illustrates in cross section a preferred embodiment of a necking apparatus with the die carrier in a closed position and the relative positions of the die and necked container.

FIG. 1 of the drawings discloses a schematic illustration of a preferred embodiment of a die carrier system and apparatus of the present invention. As shown in FIG. 1, the die carrier comprises a forming segment 102 that carries out operations on a seamless unitary metal container body 104 to achieve a reduction in the diameter of the sidewall 104A of the body, an operation also known as die necking. A cam center shaft 106 with a cam plate element 108 is secured by a cam center bearing holder 110 which allows the cam center shaft to experience linear motion in the direction of the longitudinal axis 104B of the metal container body 104. The cam center bearing holder 110 also holds and retains a cam enclosure assembly 112 through which the cam center shaft 106 and cam plate element 108 extend. The cam enclosure assembly 112 has at least one slot 114 parallel to the longitudinal axis 104B. The cam plate element 108 secures a lower cam 116. An upper cam 118, having a least one upper cam stop dog 120 fixedly attached to the upper cam 118 and extending into the slot 114 in the cam enclosure assembly 112, is slidable within the cam enclosure assembly 112. The adjoining surfaces of the lower cam 116 and the upper cam 118 are mating. The upper cam 118 secures a forming die 122. By rotating the cam center shaft 106 and attached lower cam 116 relative to the cam enclosure assembly 112, the forming die 122 and upper cam 118 constrained by the slot 114 will travel along the longitudinal axis 104B. In order to initiate a die necking operation, cam center shaft 106 and the cam enclosure assembly 112 are rotated relative to each other such that the forming die 122 is the desired distance from the cam plate element 108. The metal container body 104 is driven into and contacts a shaped inner forming surface 122A of the forming die 122 to allow the open end 104C of the metal container body 104 to conform to the shape of the inner surface 122A of the forming die 122 to form a neck portion 1041).

Figure 2:
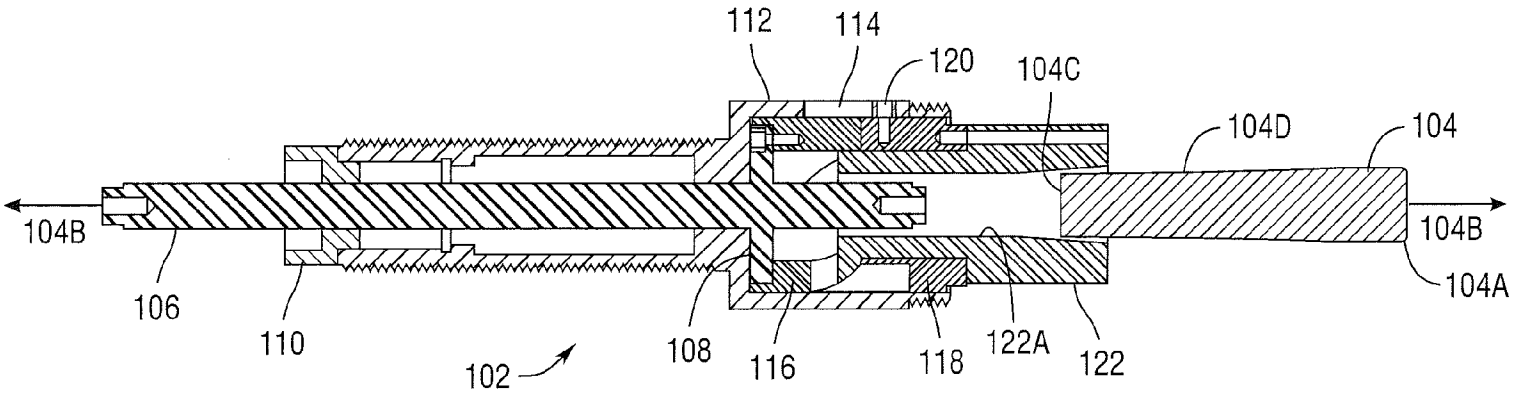
FIG. 2 illustrates in cross section a preferred embodiment of a necking apparatus with the die carrier in a open position and the relative positions of the die and necked container.

FIG. 2 illustrates a preferred overall system and apparatus of the present invention as shown in FIG. 1 but with the die carrier in a fully open position. The cam center shaft 106, cam plate element 108, and lower cam 116 have rotated relative to the cam enclosure assembly 112. The rotation has caused the upper cam 118 to move longitudinally along the axis 104B, drawing the forming die 122 further away from the cam plate element 108.

Figure 3:
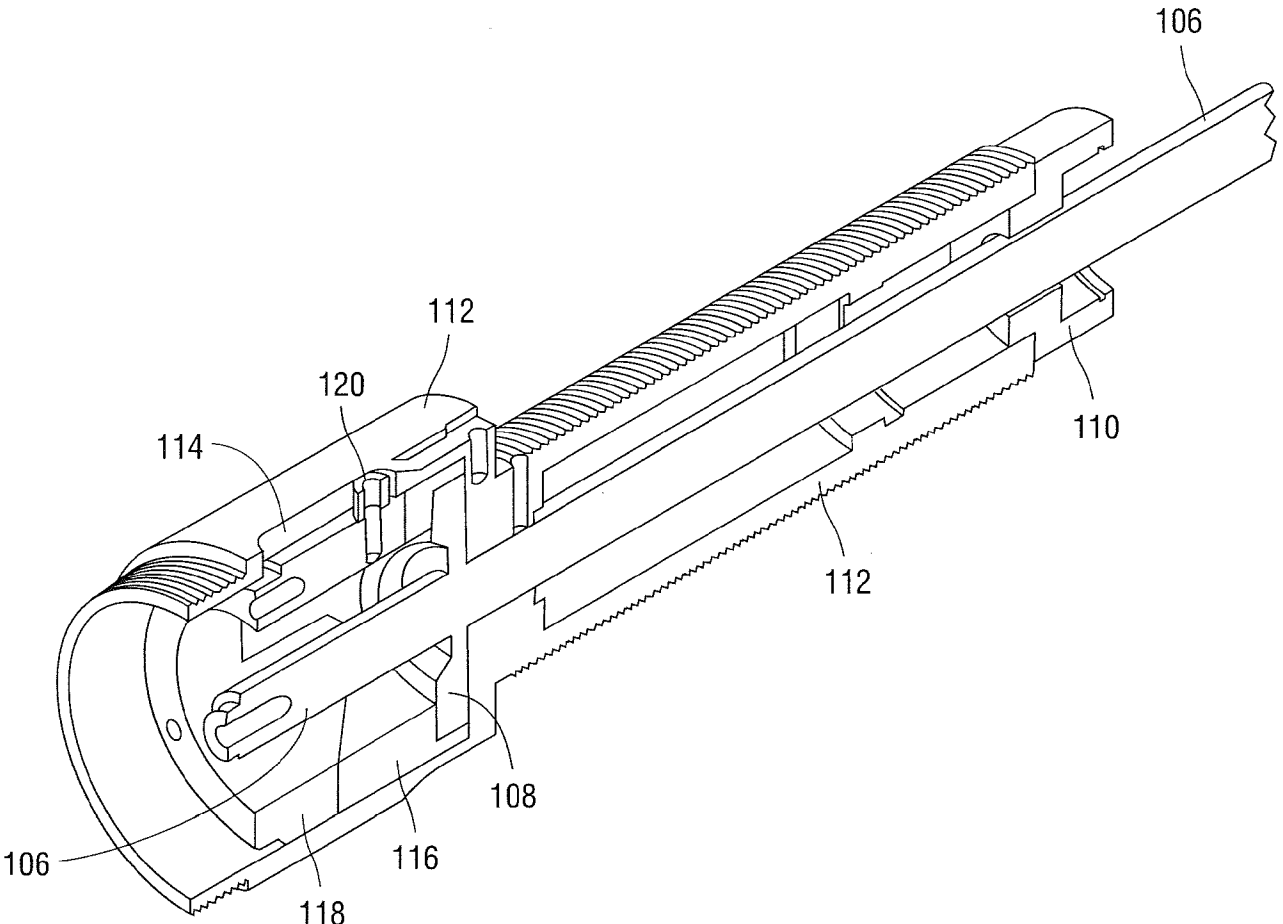
FIG. 3 illustrates a preferred embodiment of a necking apparatus with the die carrier in a closed position. The forming die and the upper cam stop dog are omitted from the drawing.

FIG. 3 illustrates internal components of a preferred necking apparatus with the die carrier in a closed position. Visible in FIG. 3 is the cam center shaft 106 passing through the cam center bearing holder 110. The outline of the cam enclosure assembly 112 is drawn, showing the attachment of the cam enclosure assembly to the cam center bearing holder 110 by threads. Visible is the lower cam 116, attached to the cam plate element 108, and mated with the upper cam 118. An upper cam stop dog 120 is affixed to the upper cam 118. A forming die 122 (not shown) is attached to the upper cam 118 at the open end of the forming segment 102. As the die carrier is in the closed position, the upper cam 118 is withdrawn into the outline of the cam enclosure assembly 112.

Figure 4:
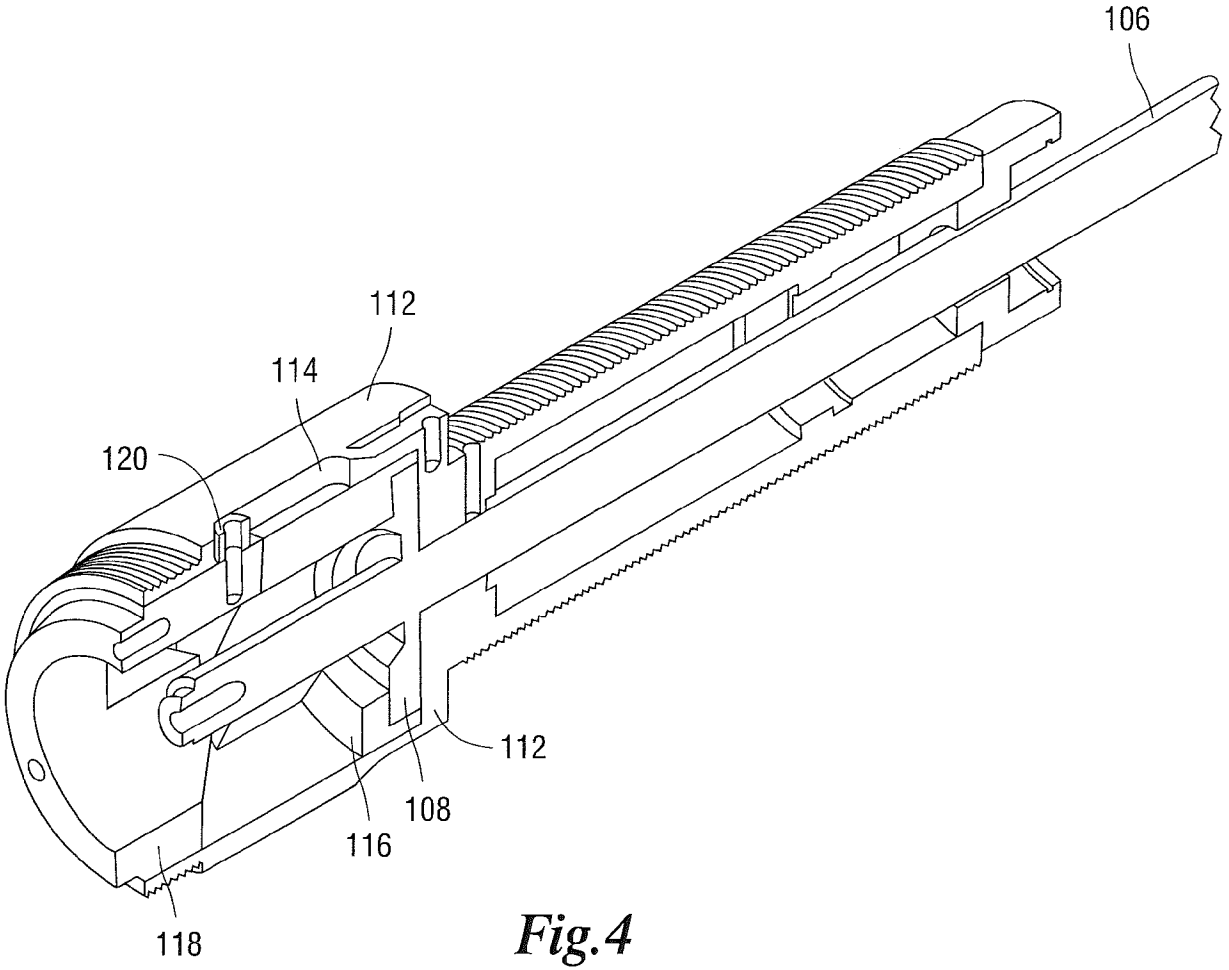
FIG. 4 illustrates a preferred embodiment of a necking apparatus with the die carrier in an open position. The forming die and the upper cam stop dog are omitted from the drawing.

FIG. 4 illustrates the same necking apparatus components with the die carrier in a fully open position. The cam enclosure assembly 112 and the cam center shaft 106 have been rotated relative to one another. The upper cam stop dog 120 in the slot 114 causes concomitant rotation of the affixed upper cam 118, while the upper cam stop dog 120 moves within the slot 114. As the die carrier 100 is in the open position, the upper cam 118 is extended outward relative to the cam plate element 108 (not shown).

Figure 5:
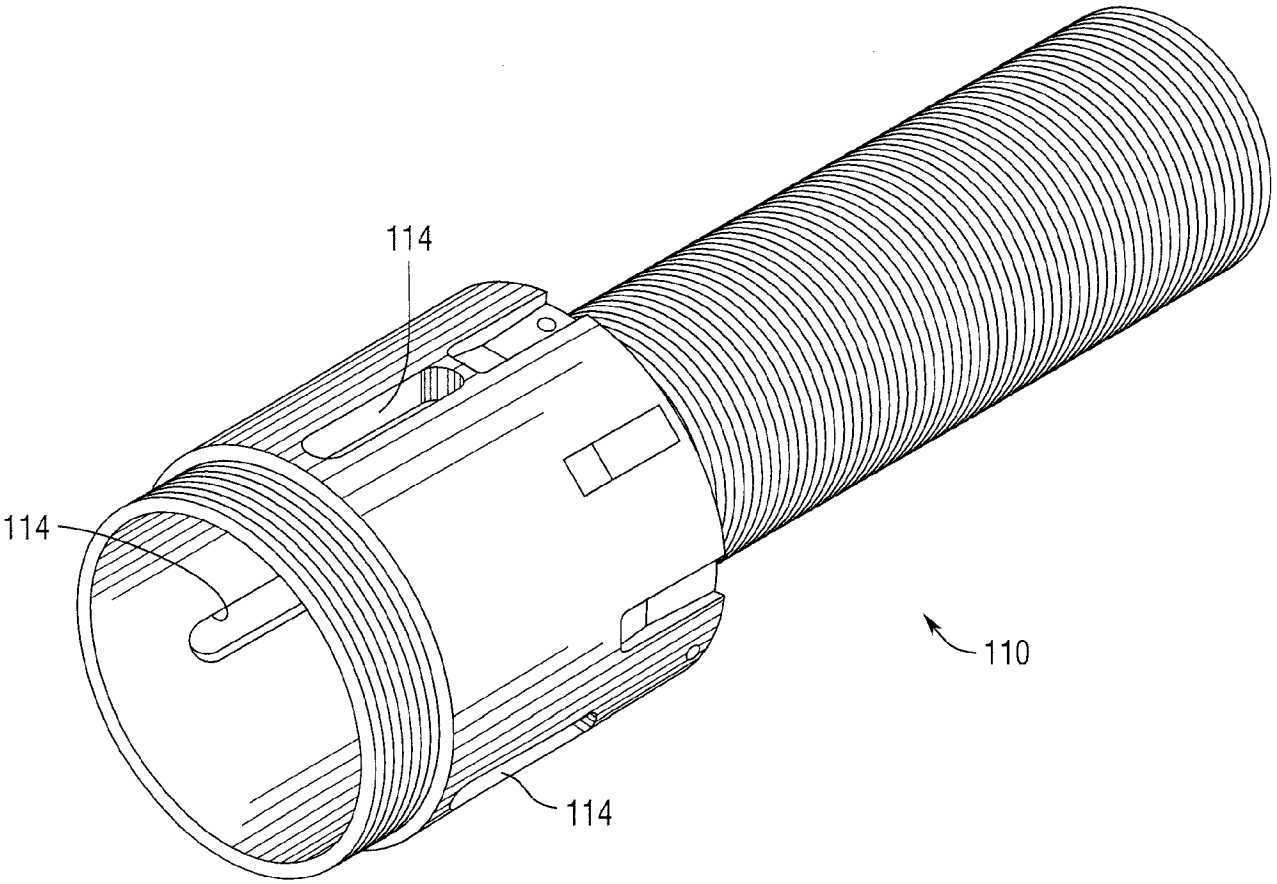
FIG. 5 illustrates a preferred cam enclosure assembly.

FIG. 5 illustrates a preferred cam center bearing holder 110 having three slots 114

Figure 6C:
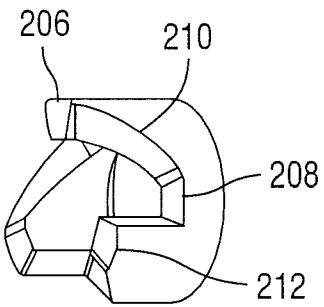
FIGS. 6A, 6B and 6C are views of a preferred lower cam of a die carrier.
Figure 6B:
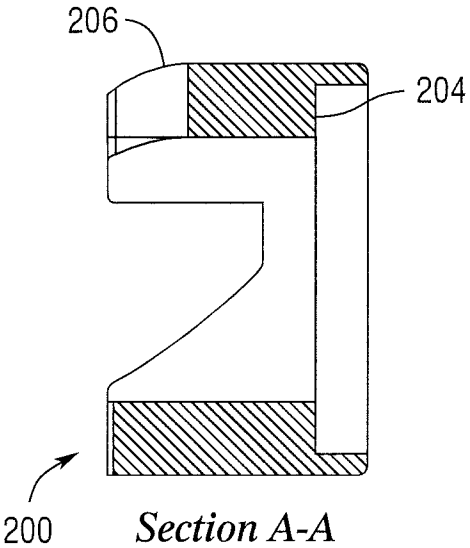
Figure 6A:
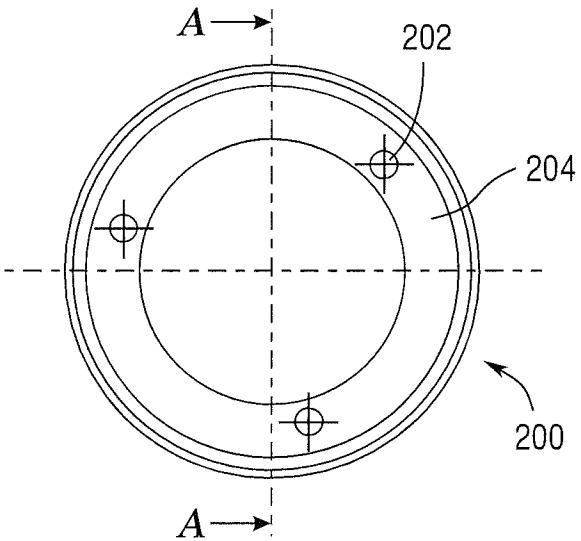

FIGS. 6A, 6B and 6C illustrate a preferred lower cam 200. FIG. 6A is a rear view of the lower cam 200 showing a plurality of threaded lower cam recesses 202 for attachment of the cam to the cam plate element 108 (not shown). FIG. 6B is a cross-section of the lower cam 200 along the axis A-A of FIG. 6A showing a lower cam depression 204 for admission of the cam plate element 108 (not shown). The perspective drawing of the same lower cam 200, as illustrated in FIG. 6C, shows three lower cam teeth 206. Each tooth 206 preferably has a lower cam bottom land 208, a lower cam sloped face 210 and a lower cam top land 212. In some preferred embodiments, there is no lower cam depression 204.

Figure 7C:
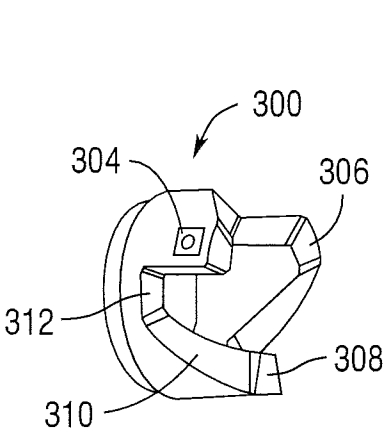
FIGS. 7A, 7B and 7C are views of a preferred upper cam of a die carrier.
Figure 7B:
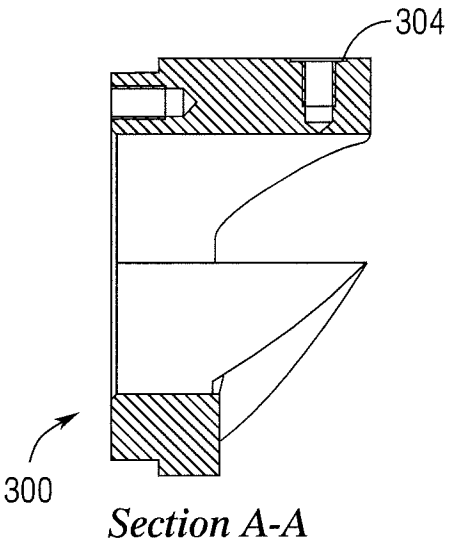
Figure 7A:
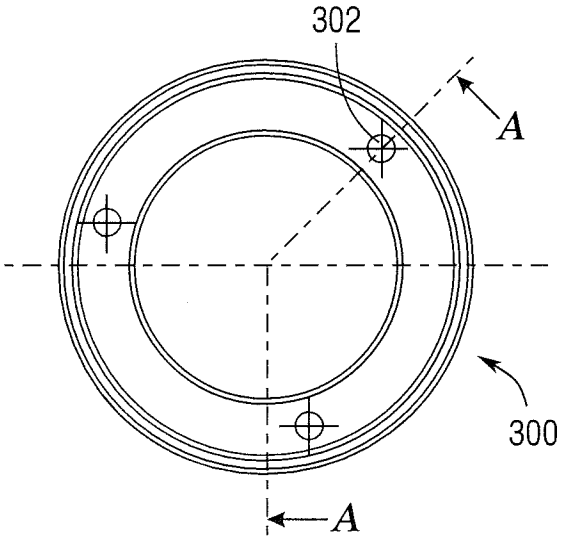

FIGS. 7A, 7B and 7C illustrate a preferred an upper cam 300 matched to the lower cam 200 of FIGS. 6A, 6B and 6C. FIG. 7A is a front view of the upper cam 300 showing a plurality of threaded upper cam recesses 302 for attachment of the cam to the forming die 122 (not shown). FIG. 7B is a cross-section of the upper cam 300 along the angular axis A-A of FIG. 7A showing a threaded cylinder recess 304 for admission of an upper cam stop dog 120 (not shown). The perspective drawing of the upper cam 300, as illustrated in FIG. 7C, shows three upper cam teeth 306. The upper cam 300 of FIG. 7C mates correspondingly with the lower cam 200 of FIG. 6C. Each upper cam tooth 306 preferably has an upper cam top land 308 corresponding to the lower cam bottom land 208, an upper cam face 310 corresponding to the lower cam face 210, and an upper cam bottom land 312 corresponding to the lower cam top land 212. In some preferred embodiments, the upper cam 300 may have one, two, three or more teeth 306.

Figure 8B:
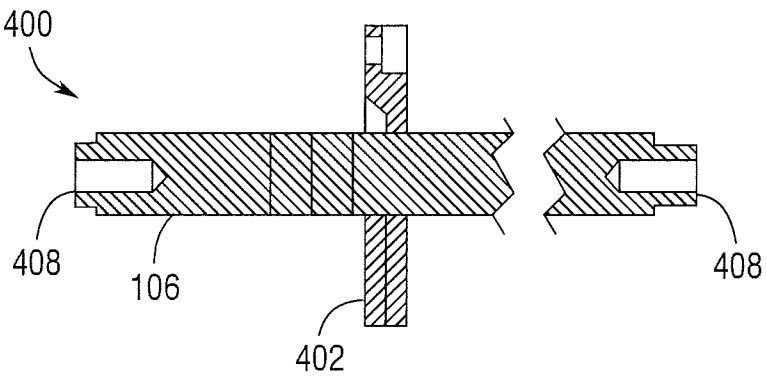
FIGS. 8A and 8B are views of a preferred cam center shaft of a die carrier.
Figure 8A:
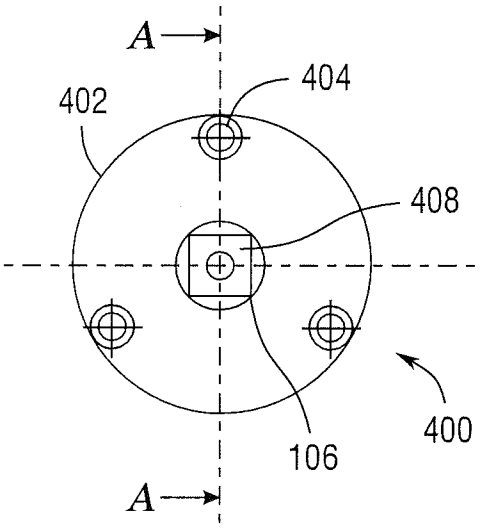

FIGS. 8A and 8B illustrate a preferred cam center shaft 400 of the present invention. The cam plate element 402 illustrated has three countersunk holes 404 for attachment of the lower cam 200 (not shown). Both cam shaft ends 406 of the cam center shaft 106 are cut square and have a threaded cam shaft recess 408 coaxial with the longitudinal axis 104B.

Figure 9A:
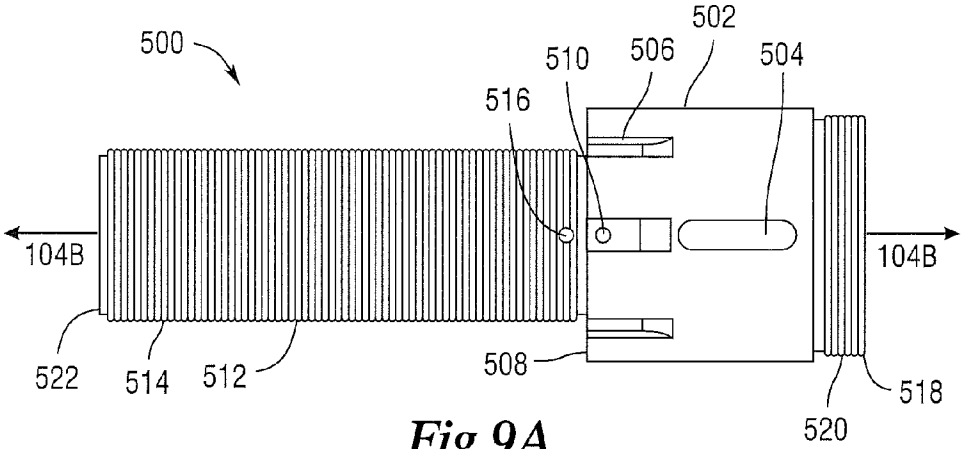
FIGS. 9A, 9B and 9C illustrate a preferred cam enclosure assembly.
Figure 9C:
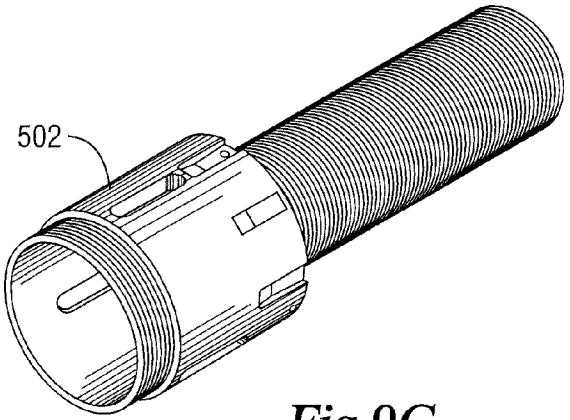
Figure 9B:
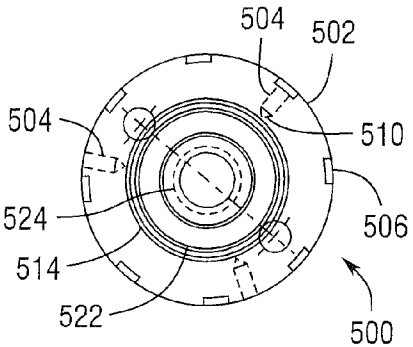

FIGS. 9A, 9B and 9C illustrate one embodiment of the cam enclosure assembly 500. FIG. 9A is a side view of the cam enclosure assembly 500 showing the hollow cylindrical main body 502 having three slots 504 parallel to the longitudinal axis 104B of the main body sized in width to accept an upper cam stop dog 120 (not shown) and sized in length to accommodate the axial travel of the upper cam stop dog as the upper cam 118 (not shown) is rotated on the longitudinal axis 104B relative to the lower cam 116 (not shown). The main body 502 has a plurality of indentations 506 to provide a grip for rotation of the main body around the longitudinal axis 104B. Near the rear end 508 of the main body 502 is at least one threaded hole 510 perpendicular to the longitudinal axis 104B to accommodate a set screw (not shown). Inserted into the rear end 508 and affixed by the set screw (not shown), to hinder relative movement upon tightening, is a cylindrical enclosure tube 512. The exposed outside surface 514 of the enclosure tube 512 is threaded. The free end 514 of the enclosure tube 512 is threaded on the inside to accommodate the thread of the stem exterior surface 610 (not shown). In the exposed outside surface 514, at the end nearer the rear end 508 is at least one threaded hole 516 perpendicular to the longitudinal axis 104B to accommodate a set screw (not shown) to hinder rotation of the enclosure tube 512 relative to the cam center shaft 106 (not shown) upon tightening. The front end 518 of the main body 502, opposite the rear end 508, has a threaded outer surface 520.

FIG. 9B is an end view from the open end 522 of the enclosure tube 512 of the cam enclosure assembly 500. The view shows the cylindrical shape of the main body 502 having three slots 504 evenly spaced around the assembly for admission of the upper cam stop dog 120 (not shown), eight indentations 506 evenly spaced around the assembly to provide grip for turning, and three threaded holes 510 for insertion of set screws (not shown). The threaded outside surface 514 of the enclosure tube 512 is revealed. In addition, the view shows a co-axial cylindrical hole 524 in the center of the cam enclosure assembly 500 to accommodate the cam center shaft 106 (not shown).

FIG. 9C is a perspective view of the cam enclosure assembly 500 of FIGS. 9A and 9B illustrating further the inside of the cylindrical main body 502 as hollow to accommodate the cam plate element 108 and attached lower cam 116 (neither shown), and the upper cam 118 and attached forming die 122 (neither shown).

Figure 10B:
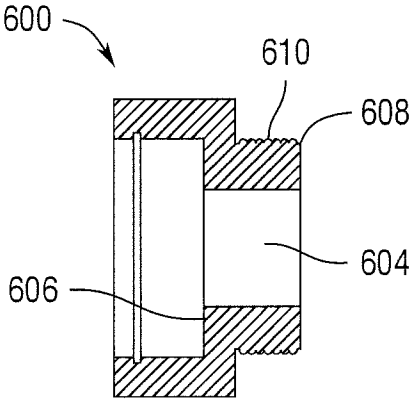
FIGS. 10A and 10B illustrate a preferred cam center bearing holder of a preferred necking enclosure sleeve.
Figure 10A:
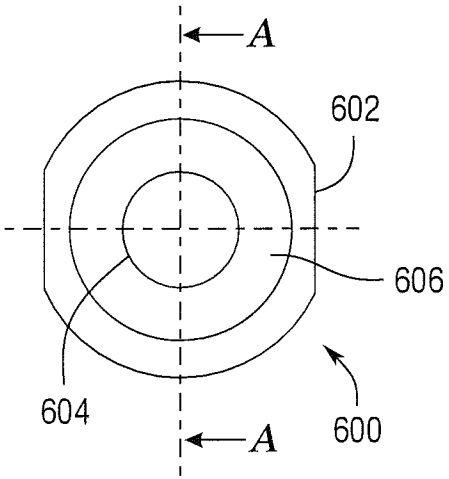

FIGS. 10A and 10B illustrate a preferred cam center bearing holder 600. FIG. 10A shows the end view of the bearing holder 600 of a cylindrical shape having two flattened sides 602 for gripping. The bearing holder 600 has a co-axial cylindrical hole 604 for acceptance of the cam center shaft 106 (not shown). Bearing holder 600 preferably has a co-axial recess 606 on the end visible in FIG. 10A. FIG. 10B is a cross-section along the axis A-A of FIG. 10A showing the cylindrical hole 604 and the co-axial recess 606. In addition, the other end of the cylindrical bearing holder 600 has a co-axial cylindrical stem section 608 threaded on the stem exterior surface 610 for attachment to the cam enclosure assembly 500 (not shown).

In various preferred embodiments, one or both of the cams 116, 118 can be rotated in opposite directions in order to elongate or shorten the entire die carrier. In some preferred embodiments the lower cam 116 and the cam center shaft 106 are not rotated, while the main body 502 is rotated causing axial movement of the upper cam 118. The upper cam 118 can be rotated such that the length of the die carrier is elongated when rotated in one direction, or shortened when rotated in the other. Thus, in various preferred embodiments when a forming die 122 is affixed to the upper cam 118, the depth of necking can be adjusted by rotating one cam relative to the other along the longitudinal axis 104B. Consequently, when a metal container body 104 enters the die, it can be necked at any appropriate distance from the lip of the open end without having to change out the forming die 122.

Since the aforementioned method and apparatus having a mechanical cam to extend the travel of the die during the necking process, readily apparent advantages are the simplicity of installation and removal, savings on machine and equipment investment, while allowing more body shaping to the sidewall of the container and increasing the neck profile on elongated profiles. The apparatus and method preferably may be installed and used on a standard necking machine to achieve deeper draw die necking. A new pre-necking machine or longer stroke necking machine would otherwise need to be purchased to achieve equal container shapes.

In order to initiate a preferred die necking operation, the cylindrical main body 502 is rotated relative to the cam center shaft 106. The rotation causes the upper cam 118 to rotate with the cylindrical main body 502 due to the upper cam stop dog 120 that slides in the slot 114 while the lower cam 116 remains fixed to the cam center shaft 106 by attachment to the cam plate element 108. The axial movement of the upper cam 118 moves the shaped inner forming surface 122A of the attached forming die 122 to a desired distance from the cam plate element 108. The metal container body 104 is pushed using a longitudinal force such that the metal container body 104 is driven into and contacts the shaped inner forming surface 122A of the forming die 122 with the force sufficient to allow the open end 104C of the container body 104 to conform to the shape of the inner surface 122A of the forming die 122 to from a neck portion 104D.

It is possible, instead of pushing the container body into the shaping die, to hold the container body 104 stationary and to rotate the main body 502 causing the upper cam 118 to move in an axial direction pushing the forming die 122 onto the container body to form a neck portion 104D.

The preferred embodiments are described for a metal container body 104. The body 104 may be, but is not limited to, an open tube or a closed tube such as a can. Air (or other gas) under pressure may be introduced into the interior of a closed tube container body 104 through a channel (not shown) in the cam center shaft 106 to pressurize the container body 104 in order to maintain its structural integrity in the radial direction during the necking operation. The body 104 may be aluminum, copper, alloys, tin or other malleable ferrous and/or nonferrous metals.

In some preferred embodiments, the cams 200 and 300 may have one, two, three, four or more teeth 206 and 306. The cam tooth may comprise a bottom land 208 and 312, a helical surface 210 and 310, and a top land 212 and 308. In other preferred embodiments, the tooth may comprise one or more helical surfaces 210 and 310 but no lands. In some preferred embodiments, the lands 208, 212, 308, and 312 are flat, while in other preferred embodiments the lands have curvature. In some preferred embodiments, the cams 200 and 300 may have one or more intermediate lands spaced along the helical surfaces 210 and 310. Intermediate lands preferably may allow for stepwise adjustment of the die necking apparatus.

The die necking may be carried out by one neck forming segment 102, or a plurality of neck forming segments in parallel or in series.

In the foregoing Detailed Description, various features are grouped together in one or more preferred embodiments to streamline the disclosure. This method of disclosure is not to be interpreted as reflecting an intention that the claimed devices or methods require more features than are expressly recited in each claim. Rather, as the following claims reflect, inventive subject matter lies in less than all features of a single disclosed embodiment. Thus, the following claims are hereby incorporated into the Detailed Description, with each claim standing on its own as a separate embodiment.

What is claimed is:

1. A method for die necking comprising: providing a die necking apparatus comprising a helical cam set having a lower cam and an upper cam disposed within a hollow main body co-axially about a longitudinal axis of a cam center shaft, wherein the upper cam has an attached necking die with a shaped inner forming surface; rotating the lower cam to cause axial movement of the upper cam with respect to the hollow main body, restraining the relative rotation of the helical cam set, inserting a metal container body into the necking die, and conforming the metal container body to the shape of the inner forming surface.

2. The method of claim 1 wherein the metal container body is aluminum or an aluminum alloy.

3. The method of claim 1 wherein the metal container body is a can.

4. The method of claim 1 further comprising withdrawing the metal container body from the necking die, unrestraining the relative rotation of the helical cam set, rotating the upper cam relative to the lower cam so the necking die moves further from the lower cam, restraining the relative rotation of the helical cam set, inserting the metal container body into the necking die, and conforming the metal container body to the shape of the inner forming surface.

* * * * *